US008245841B2

(12) United States Patent
Agirbas

(10) Patent No.: US 8,245,841 B2
(45) Date of Patent: Aug. 21, 2012

(54) SMOKING ARTICLE PACKET WITH SLIDE APERTURE

(75) Inventor: Erdinc Agirbas, Bayreuth (DE)

(73) Assignee: British American Tobacco (Germany) GmbH, Hamburg (DE)

( * ) Notice: Subject to any disclaimer, the term of this patent is extended or adjusted under 35 U.S.C. 154(b) by 0 days.

(21) Appl. No.: 12/096,017

(22) PCT Filed: Nov. 7, 2006

(86) PCT No.: PCT/EP2006/010648

§ 371 (c)(1),
(2), (4) Date: Sep. 17, 2008

(87) PCT Pub. No.: WO2007/065514

PCT Pub. Date: Jun. 14, 2007

(65) Prior Publication Data

US 2009/0008277 A1 Jan. 8, 2009

(30) Foreign Application Priority Data

Dec. 8, 2005 (DE) ..... 10 2005 058 720

(51) Int. Cl.
*B65D 85/10* (2006.01)
*B65D 5/54* (2006.01)

(52) U.S. Cl. ... 206/268; 206/273; 206/815; 229/125.08; 229/160.1

(58) Field of Classification Search ..... 206/264–270, 206/815, 259; 229/125.125, 160.1, 125.07, 229/125.08

See application file for complete search history.

(56) References Cited

U.S. PATENT DOCUMENTS

| | | | | |
|---|---|---|---|---|
| 2,929,542 | A | | 3/1960 | Gorman |
| 304,832 | A | | 8/1962 | Hovland et al. |
| 3,048,320 | A | | 8/1962 | Hovland et al. |
| 3,214,009 | A | * | 10/1965 | Tamarin ..... 206/273 |
| 3,272,321 | A | * | 9/1966 | Tamarin ..... 206/268 |
| 3,311,283 | A | * | 3/1967 | Shimada et al. ..... 229/125.08 |
| 377,324 | A | | 11/1973 | Mueller |

(Continued)

FOREIGN PATENT DOCUMENTS

CH 370699 7/1963

(Continued)

OTHER PUBLICATIONS

International Search Report dated Jan. 11, 2007 for International Application No. PCT/EP2006/010648.

(Continued)

*Primary Examiner* — Bryon Gehman
(74) *Attorney, Agent, or Firm* — Chadbourne & Parke LLP

(57) ABSTRACT

The invention relates to a smoking article packet with an inner packet part for accommodating the smoking articles and an outer packet part for accommodating the inner packet part. The outer packet part has one substantially open face through which the inner packet part can be pushed out of the packet part with a slide aperture in the outer packet part. It also relates to a smoking article packet in which the inner packet part has a lid attached to it, or articulated, and a lid opening tab is provided in the region of the articulation line. The lid opening tab has a cut-out in which a co-operating piece on the outer packet part is able to engage, causing the lid to open as the inner packet part is being pushed out of the outer packet part.

21 Claims, 8 Drawing Sheets

U.S. PATENT DOCUMENTS

| | | | | |
|---|---|---|---|---|
| 3,773,247 | A | 11/1973 | Mueller | |
| 393,329 | A | 1/1976 | Shimada et al. | |
| 3,933,299 | A | 1/1976 | Shimada et al. | |
| 397,752 | A | 8/1976 | Grimm | |
| 3,977,520 | A | 8/1976 | Grimm | |
| 404,911 | A | 9/1977 | Grimm | |
| 4,049,117 | A | 9/1977 | Grimm | |
| 424,054 | A | 12/1980 | Stio | |
| 4,240,548 | A | 12/1980 | Stio | |
| 426,792 | A | 5/1981 | Toimil | |
| 4,267,926 | A | 5/1981 | Toimil | |
| 4,646,960 | A * | 3/1987 | Challand | 206/268 |
| 6,474,468 | B1 * | 11/2002 | Griffith | 206/267 |
| 2005/0103654 | A1 * | 5/2005 | Hennessy | 206/270 |

FOREIGN PATENT DOCUMENTS

| | | | |
|---|---|---|---|
| DE | 1052308 | | 3/1959 |
| DE | 1285948 | B | 12/1968 |
| DE | 2113844 | A | 9/1972 |
| DE | 2113844 | A1 | 9/1972 |
| DE | 2809548 | | 9/1978 |
| DE | 20302162 | | 6/2004 |
| EP | 0183397 | A2 | 4/1986 |
| EP | 1105313 | B1 | 8/1999 |
| FR | 1081649 | | 12/1954 |
| GB | 103246 | A | 1/1917 |
| GB | 505550 | A | 5/1939 |
| GB | 979302 | | 1/1965 |
| GB | 2115386 | A | 9/1983 |
| WO | WO 98/18683 | | 5/1998 |
| WO | 00/45654 | A1 | 8/2000 |
| WO | WO 00/45654 | | 8/2000 |
| WO | 03/089316 | A1 | 10/2003 |
| WO | WO2004024595 | A1 | 3/2004 |
| WO | WO 2004/063032 | | 7/2004 |
| WO | WO 2004/074123 | | 9/2004 |
| WO | WO 2005/090172 | | 9/2005 |

OTHER PUBLICATIONS

Written Opinion of the International Searching Authority, issued on Jan. 29, 2007 for PCT/EP2006/010648, filed Nov. 7, 2006.

International Preliminary Report on Patentability, issued on Oct. 14, 2008 for PCT/EP2006/010648, filed Nov. 7, 2006.

Notice of Opposition to a European Patent, dated Jun. 15, 2011 for European Patent No. EP1960275.

German Office Action, dated Aug. 9, 2011 for German Patent Application No. 102005058720.8.

Russian Office Action, dated May 28, 2009 for Russian Patent Application No. 2008126835.

* cited by examiner

SMOKING ARTICLE PACKET WITH SLIDE APERTURE

CLAIM FOR PRIORITY

This application is a National Stage Entry entitled to and hereby claims priority under 35 U.S.C. §§365 and 371 corresponding to PCT Application No. PCT/EP2006/010648, titled, "SMOKING-ARTICLE PACK WITH PUSH-OUT APPERTURE," filed Nov. 7, 2006, which in turn claimed priority to German Application Serial No. 10 2005 058 720.8, filed Dec. 8, 2005; all of which is hereby incorporated by reference.

The invention relates to a packet for smoking articles, in particular for cigarettes. More specifically, it relates to a packet which falls within the known category of shell and slide packets.

Shell and slide packets, in particular for cigarettes, are already known from the prior art. What packets in this category have in common is the fact that the packets are made from two cuttings as a rule. One cutting encloses the block of cigarettes and constitutes the inner part of the packet. The second cutting accommodates the inner packet part with the block of cigarettes and thus constitutes the outer packet part. The inner packet part is able to slide in the outer packet part, thereby giving the consumer access to the cigarettes.

Shell and slide packets are known from the prior art which are opened by sliding the packet in a direction perpendicular to the cigarette axis in the packet (first category), or alternatively by sliding along the cigarette axis (second category).

Belonging to the first category are packets based on designs described in patent specifications WO 2004/024595A and GB 211 5386A, for example. These are basically packets of a three-dimensional rectangular shape, the inner packet part of which is open at the top end at a narrow face to permit access to the cigarettes. The other five sides of the inner packet part are closed. No seal or lid element is provided over the open end. The outer packet part is likewise closed on five sides, but the open side is a narrow side. On the oppositely lying narrow side, a cut-out is provided, through which the inner packet part can be pushed out of the outer packet part. The packet can not be easily and ergonomically opened and closed using one hand but requires the use of both hands.

The second category covers many more designs. These are also packets of an essentially three-dimensional rectangular shape. The cigarettes are disposed in the inner packet parts. However, the packets are also closed by a seal or lid element at the top end. The seal of the inner packet part is opened by pushing the inner packet part out of the outer packet part in various ways and is often also closed again when pushed back in.

The outer packet part may be smaller than the inner packet part. This being the case, it forms a type of band around the inner packet part, which can be pushed up and down on the inner packet part. Examples of these packets are described in patent specifications U.S. Pat. Nos. 3,773,247, 3,977,520, GB 979302 and U.S. Pat. No. 4,049,117. Again in this instance, the packet can hardly be opened and closed with one hand and can in no way be described as ergonomic.

What is distinctive about most packets which fall within the second category, however, is that the outer packet part surrounds the inner packet part across the entire packet height but leaves the bottom and top surface exposed. The packet is pushed up out of the outer packet part from the bottom end. This action again requires the use of a second hand and can not be performed ergonomically with one hand.

Packets of the type described above essentially differ solely due to the mechanism used to open the seal or lid of the inner packet part and optionally close it again. A few of these designs will be described in more detail.

Patent specifications DE 28 09 548, U.S. Pat. Nos. 3,311,283 and 4,646,960 describe hook-type folds on both packet parts, which locate with one another on sliding out and open the lid of the inner packet parts. U.S. Pat. No. 3,933,299 and EP 1 105 313 also describe a similar opening mechanism but are different from the other packets due to a partially closed bottom end of the outer packet part.

The disadvantage of such designs of opening mechanism is that these folds are complex and there is no guarantee that they will function reliably once the mechanism has been used several times. U.S. Pat. No. 4,240,548 and DE 10 52 308 describe packets which open a lid by means of a Z-shaped fold and release a part of or the entire top surface of the inner packet part. The disadvantage of such designs is that the lids are not very strong and it is necessary to glue the inner packet part to the outer packet part in order to produce the closing and opening mechanism.

U.S. Pat. Nos. 3,048,320 and 4,267,926 describe packets whereby the inner packet part is connected to the outer one by (a or) several flexible cutting elements. When the inner packet part is pushed out, this flexible connection firstly rolls along and then opens the lid of the packet. Here too, additional gluing and the problematic mechanism of the connecting part represent disadvantages.

Patent specification CH 370699 discloses a packet with an opening mechanism of the type whereby a material strip of the inner packet part moves in a groove when pushed out, arrives at a stop and folds open the packet lid as the pushing out movement continues. As with U.S. Pat. No. 3,933,299, the bottom face of the outer packet part of this packet is partially closed and is only accessible by punching it out. The disadvantage of this packet is that the opening mechanism is of a very unstable design and parts project out beyond the rest of the packet dimensions.

In summary, it may be said that all packets of both categories have disadvantages in terms opening and closing the packet ergonomically and are often impractical to manufacture due to unstable mechanical elements and complex folds, as well as being unreliable.

This invention represents an improvement on the prior art in that the disadvantages outlined above are overcome. In particular, one objective of the packet proposed by the invention is to offer an opening mechanism which can be operated very ergonomically.

The objectives of the invention are achieved as defined in claim 1 and preferred embodiments are described in the associated dependent claims.

Accordingly, the invention relates to a smoking article packet with an inner packet part for accommodating the smoking articles and an outer packet part for accommodating the inner packet part, and the outer packet part has one essentially open face through which the inner packet part can be pushed out of the outer packet part, and with a slide aperture in the outer packet part. The slide aperture lies essentially on a face of the outer packet part that does not lie opposite the open face. In other words, the slide aperture lies on a face to which a pushing force is applied, the active element of which essentially acts along the face, and does so in a manner differently from that of the prior art where a pushing force is usually applied but the active element of it acts essentially perpendicular to the face during the opening operation. The advantage of these faces with the slide aperture chosen by the invention is that they can be reached ergonomically with the same hand which is also holding the packet, so that opening can take place comfortably with one hand. The packet is also easy to manufacture and in particular can be integrated in the production process without any major modifications to existing packaging machine technology.

In one embodiment, the face or a portion of the face with the slide aperture is essentially not parallel with the open face, and in particular subtends an angle of more than 30°, more especially an angle of 90°, with the open face. The slide aperture may therefore lie on a face which essentially adjoins the open face directly and in particular is perpendicular to it.

As a result of the invention, the inner packet part can be pushed out of the outer packet part perpendicular to the longitudinal axis of the smoking articles. On the other hand, it is also possible for the inner packet part to be pushed out of the outer packet part parallel with the longitudinal axis of the smoking articles.

A slide aperture may be disposed on various faces, namely on at least one of two oppositely lying larger main faces of the packet, or essentially on at least one of two oppositely lying smaller side faces of the packet. It would also be possible to provide more than one slide aperture on one or more faces of the outer packet part, which do not lie opposite the open face.

In its different embodiments, the packet is a packet of a three-dimensional rectangular shape with six faces and

- the open face is one of the shorter, narrow edge faces and the slide aperture is disposed on at least one of the longer, narrow edge faces and/or at least one of the main faces; or
- the open face is one of the longer, narrow edge faces and the slide aperture is disposed on at least one of the shorter, narrow edge faces and/or at least one of the main faces; or
- the open face is one of the main faces and the slide aperture is disposed on at least one of the longer, narrow edge faces and/or at least one of the shorter, narrow edge faces.

In particular, the slide aperture is a cult-out from the face of the outer packet part, and more especially the slide aperture has a rounded, in particular circular or oval shape, and/or an elongate slot shape, and/or a shape with corners, in particular a rectangular, square or triangular or polygonal shape.

In the pushing-out direction, the slide aperture may have a length which corresponds to at least one fifth of the face length in this direction and may occupy up to 90% of the face length. Perpendicular to the pushing-out direction, the slide aperture may have a width of at least 2 mm, in particular at least 5 mm and more especially at least 10 mm.

In one embodiment, the inner packet part has a friction-enhancing or purchase-enhancing surface or a slide aid and in particular it has a fold-out slide aid.

The inner packet part of one embodiment has a lid disposed on it and in particular articulated, which lies on the open face of the outer packet part when the inner packet part is pushed in. Accordingly, the lid is disposed on an articulation line of the inner packet part in a hinge-type arrangement so that it can be folded out, and in particular a lid opening tab is disposed in the region of the articulation line between the lid and the face of the inner packet part adjoining the articulation line which opens the lid when the inner packet part is pushed out of the outer packet part. In particular, the lid opening tab has an engagement or contact system, in particular a cut-out, in which a co-operating piece on the outer packet part can engage, causing the lid to open when the inner packet part is pushed out of the outer packet part.

An opening mechanism proposed by the invention is totally reliable and simple and the inner packet part is sufficiently secured to prevent it from slipping out of the outer packet part.

By virtue of another aspect, the invention relates to a smoking article packet, in particular of the type described above, with an inner packet part for accommodating the smoking articles and an outer packet part for accommodating the inner packet part, and the outer packet part has one essentially open face through which the inner packet part can be pushed out of the outer packet part, and the inner packet part has a lid disposed on it, in particular articulated, and a lid opening tab is disposed in the region of the articulation line between the lid and the face of the inner packet part adjoining the articulation line. The lid opening tab has a cut-out in which a co-operating piece on the outer packet part can engage, causing the lid to open when the inner packet part is pushed out of the outer packet part.

In one embodiment, the co-operating piece on the outer packet part has a tab disposed at and in particular punched into its edge, which can be folded inwards by 180° and has catch lugs. Also conceivable is a tab arranged in several segments, which can be folded inwards by 180° due to a groove along the edge, thereby assuming the function of a "catch lug(s)". It is also possible in particular to opt for a design whereby the cut-out of the lid opening tab lies closer to the articulation line than at least one other cut-out which is used to restrict the pushing-out movement. In a different design of the tab 33, however, the tabs 21, 23, 24 may lie in a line.

The invention will now be explained in more detail with reference to embodiments illustrated in the appended drawings. The person skilled in the art will naturally be aware that these merely represent examples and obvious design variants of the packet, e.g. with packet edges that are rounded or one or more that are oblique, all of which fall within the scope of the invention relating to the packet.

In the drawings, solid lines represent edges of the cutting and broken lines represent folding or bending lines. Parts in the drawings denoted by the same reference numbers fulfil exactly the same function. Of the drawings.

Figure 1C:
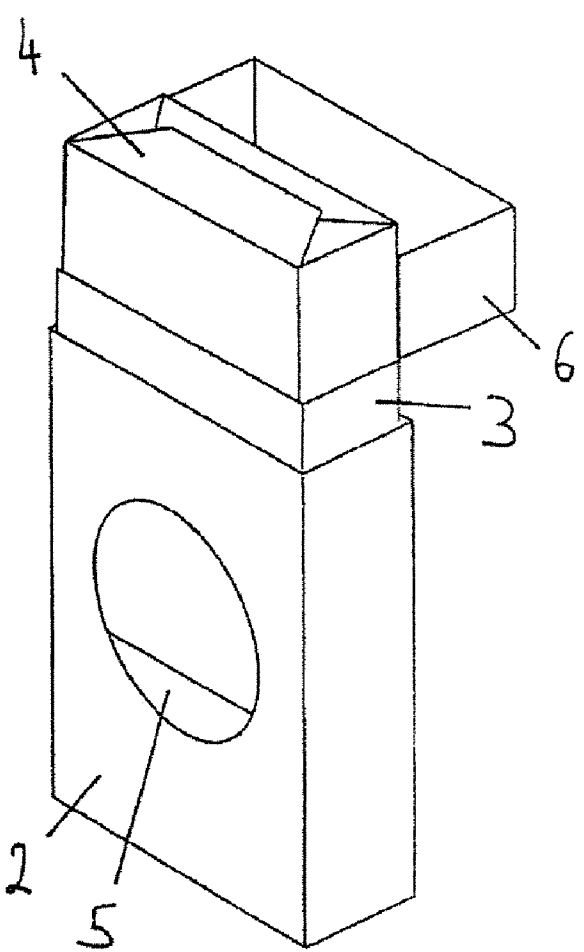
FIG. 1 is a three-dimensional diagram of the opening mechanism of a packet proposed by the invention.
Figure 1B:
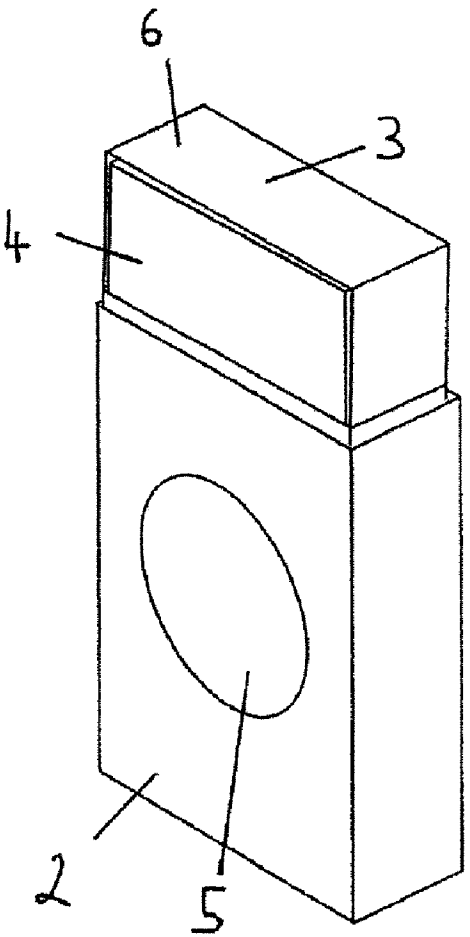
Figure 1A:
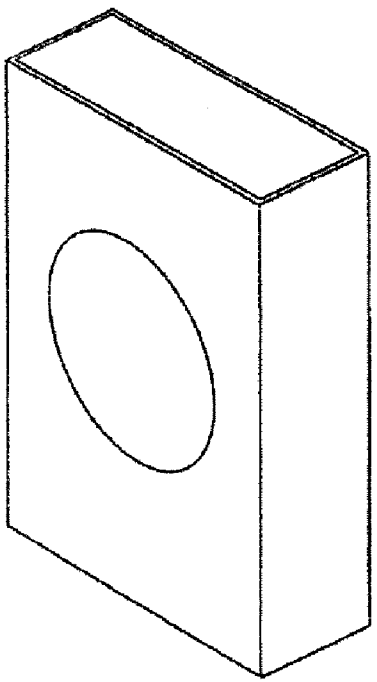

FIG. 1*a* illustrates the closed packet proposed by the invention. In order to push the inner packet part 3 out of the outer packet part 2, a cut-out 5 is provided in the outer packet part 2, FIG. 1*b*. To do this, the consumer can hold the packet in one hand and act on the inner packet part 3 through the cut-out 5 using the thumb, for example, and push the packet upwards. Whilst doing this, the packet is held in one hand in the same way a mobile telephone would be held when typing in a number with the thumb of the same hand.

When the inner packet part 3 is pushed out, the enclosed cigarette block 4 becomes visible. If the inner packet part 3 is pushed farther out of the outer packet part 2, the lid 6 of the packet attached to the inner packet part 3 starts to open. The inner packet part 3 can be pushed as far as a stop, which prevents the inner packet part 3 from unintentionally sliding totally out of the outer packet part. By the time the movement has reached the stop, the lid 6 has fully opened and in particular is folded back by more than 90°, exposing the enclosed cigarette block 4 (FIG. 1*c*).

Figure 1:
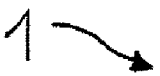

The cut-out 5 illustrated in FIG. 1 is circular in shape. However, it could also be an elongate slot, oval, rectangular, square or triangular, for example. For practical purposes, however, the cut-out 5 should be sufficiently large for the packet to be fully opened and closed with one movement, in particular without having to push again.

Figures 2, 2A, 2B, 2C, 2D:
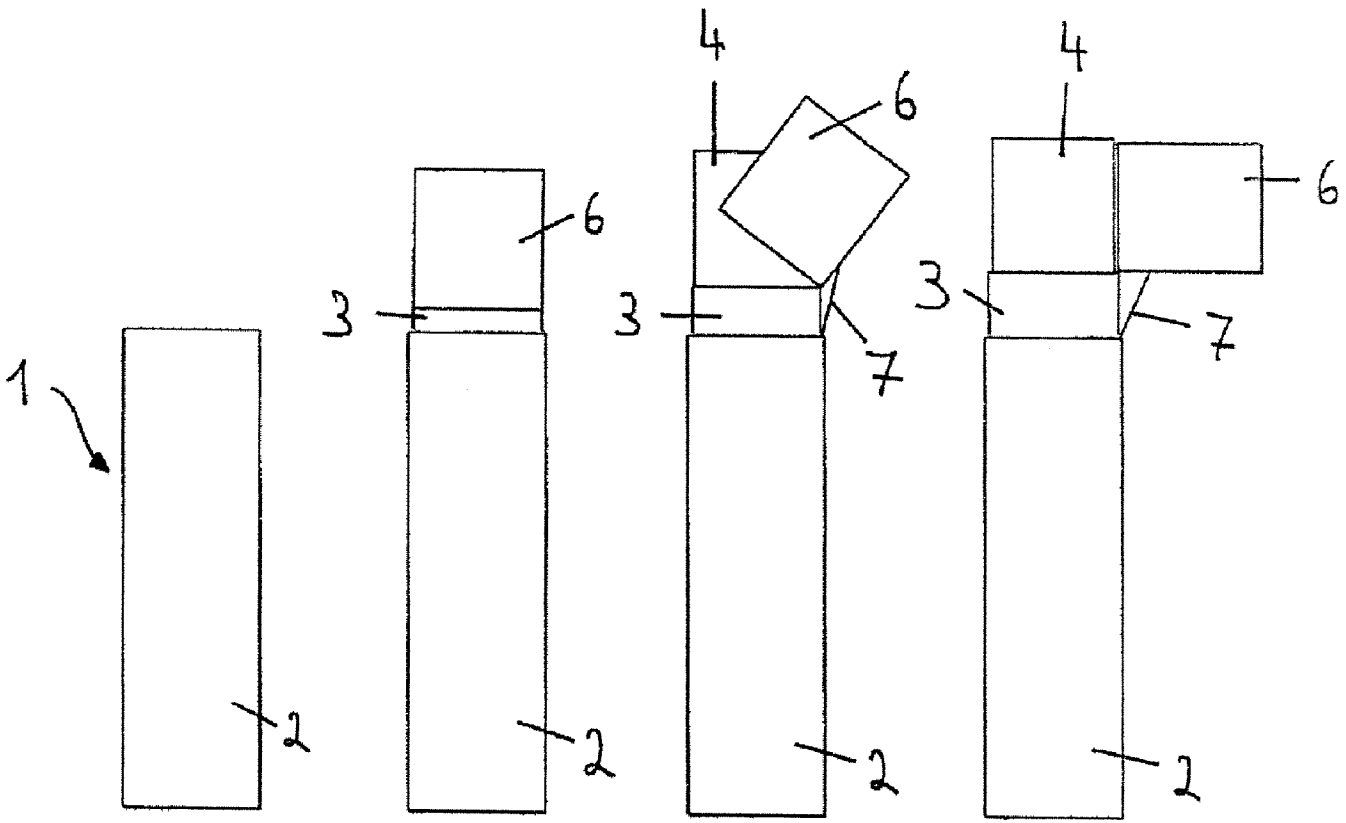
FIG. 2 is a side view of the opening mechanism of a packet proposed by the invention.

FIG. 2 illustrates the opening mechanism again but from the side, showing the completely closed packet 1 in FIG. 2*a* and the intermediate stages illustrated in FIGS. 2*b* and 2*c* until the packet 1 is fully opened as in FIG. 2*d*. The tongue 7 which opens the lid 6 as the inner packet part 3 is pushed out is visible. This mechanism engages in a position of the inner packet part 3 between those illustrated in FIGS. 2*b* and 2*c*.

Figure 3:
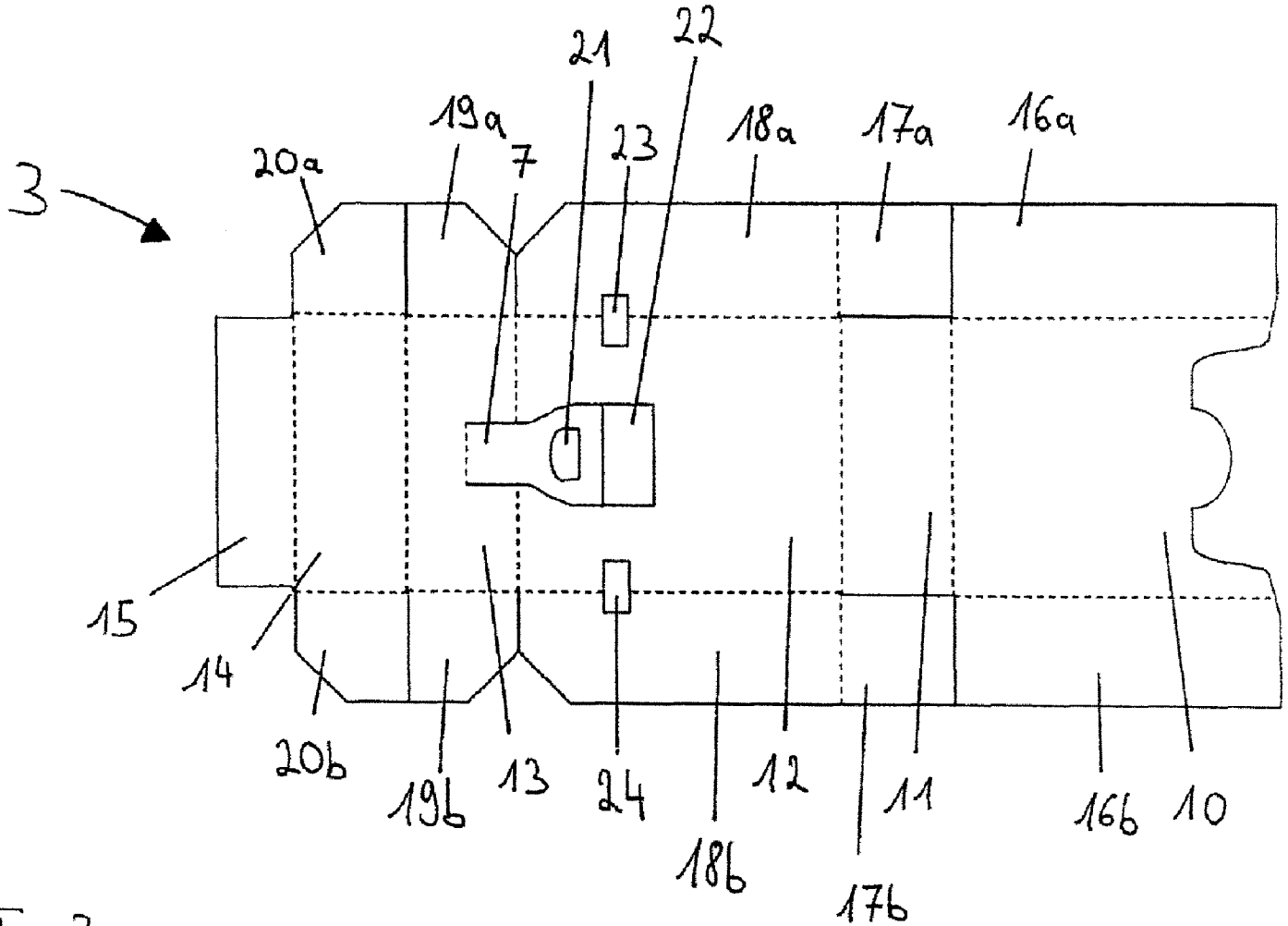
FIG. 3 shows a cutting for a first embodiment of an inner packet part.
Figure 4:
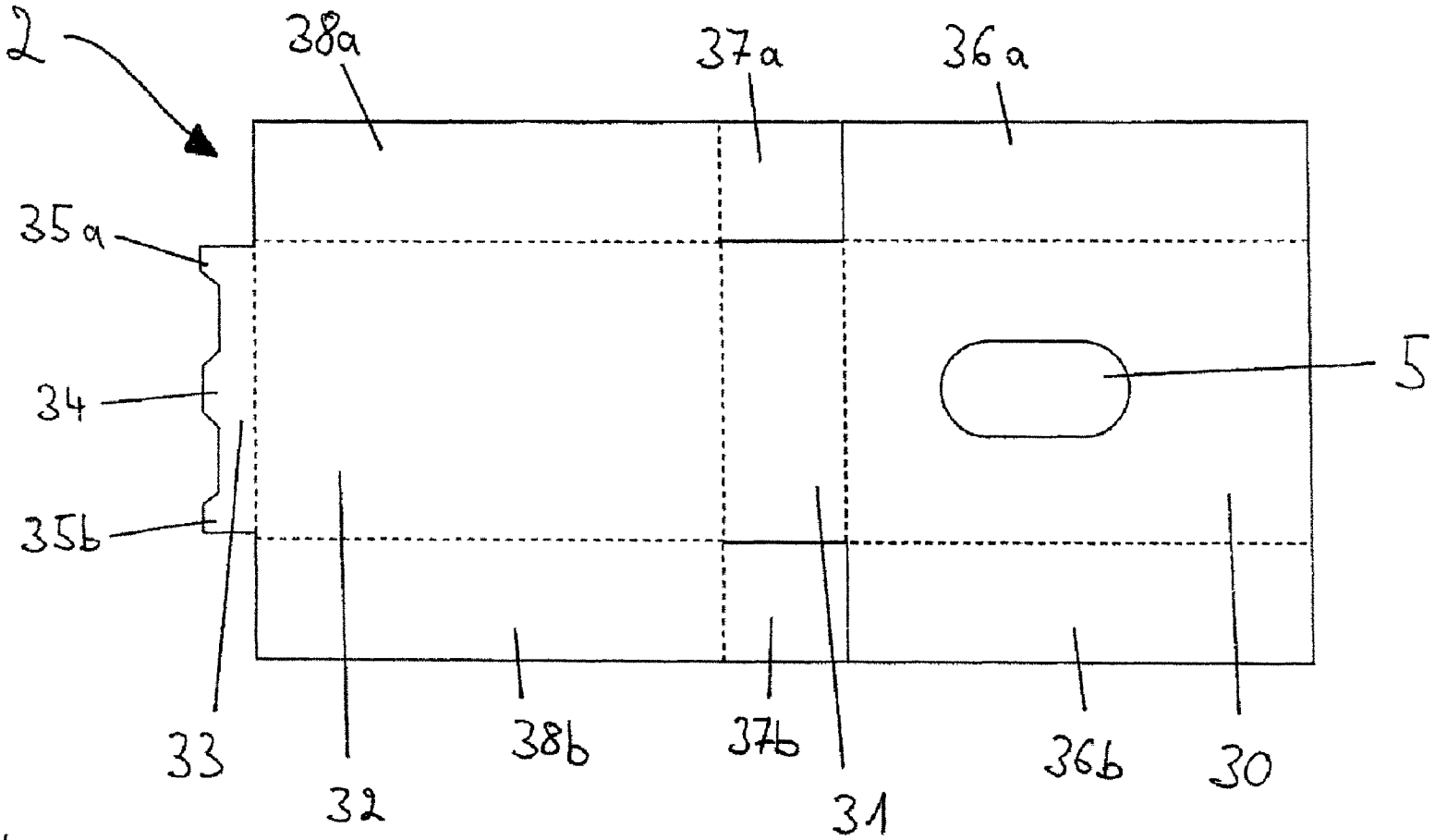
FIG. 4 shows a cutting for a first embodiment of an outer packet part.

Looking now at the cuttings used for the inner packet part 3 and the outer packet part 2 illustrated in FIGS. 3 and 4, the functional elements of the opening mechanism will be more readily understandable.

FIG. 3 illustrates the inner packet part 3. In detail, reference 10 denotes the front face, 11 the bottom face, 12 the rear face, 13 the reverse side of the lid, 14 the top face, 15 a lid stiffening, 16*a* and *b* side flaps of the front face, 17*a* and *b* side flaps of the bottom face, 18*a* and b side flaps of the rear face, 19*a* and *b* and 20*a* and *b* side flaps of the lid. The inner packet part 3 is folded and glued in a conventional manner in order to produce an essentially three-dimensional rectangular compartment for the enclosed cigarette block.

Disposed in the region of the rear face 12 and the reverse side of the lid 13 is the tongue 7 of the opening mechanism. Disposed underneath the tongue is a cut-out 22 in which the tongue is able to move during the movement which takes place when the lid 6 is being opened. A cut-out 21 is also provided in the tongue, in which a lug on the outer packet part engages in order to open the lid 6. The two cut-outs 23 and 24 act as stops to prevent the inner packet part 3 from being unintentionally pushed out of the outer packet part.

FIG. 4 illustrates the outer packet part. In detail, 30 denotes the front face, 31 the bottom face, 32 the rear face, 33 the tab, 34 the opening lug, 35*a* and *b* stop lugs, 36*a* and *b* side flaps of the front face, 37*a* and *b* side flaps of the bottom face and 38*a* and *b* side flaps of the rear face. The cut-out 5 in this case is an elongate slot. The outer packet part 2 is folded and glued in a conventional manner to obtain an essentially three-dimensional rectangular space for receiving the inner packet part 3.

The tab 33 is folded inwards by 180° and due to the rebound forces intrinsic to the material strives to locate in the co-operating cut-outs in the inner packet part as the latter is being pushed out of the packet part. This function is fulfilled by the lug 34, which is able to engage in the cut-out 21, and the lugs 35*a* and *b* which are able to engage in the cut-outs 23 and 24 as the inner packet part 3 is being pushed out of the outer packet part 2.

To facilitate the mutual engagement of the lugs and cut-outs, it is possible and of advantage to impart an appropriate three-dimensional shape to the co-operating regions of the packet cuttings during the punching and groove-forming process using an appropriate punching tool in the region 21, 22 of the tab.

Figure 5:
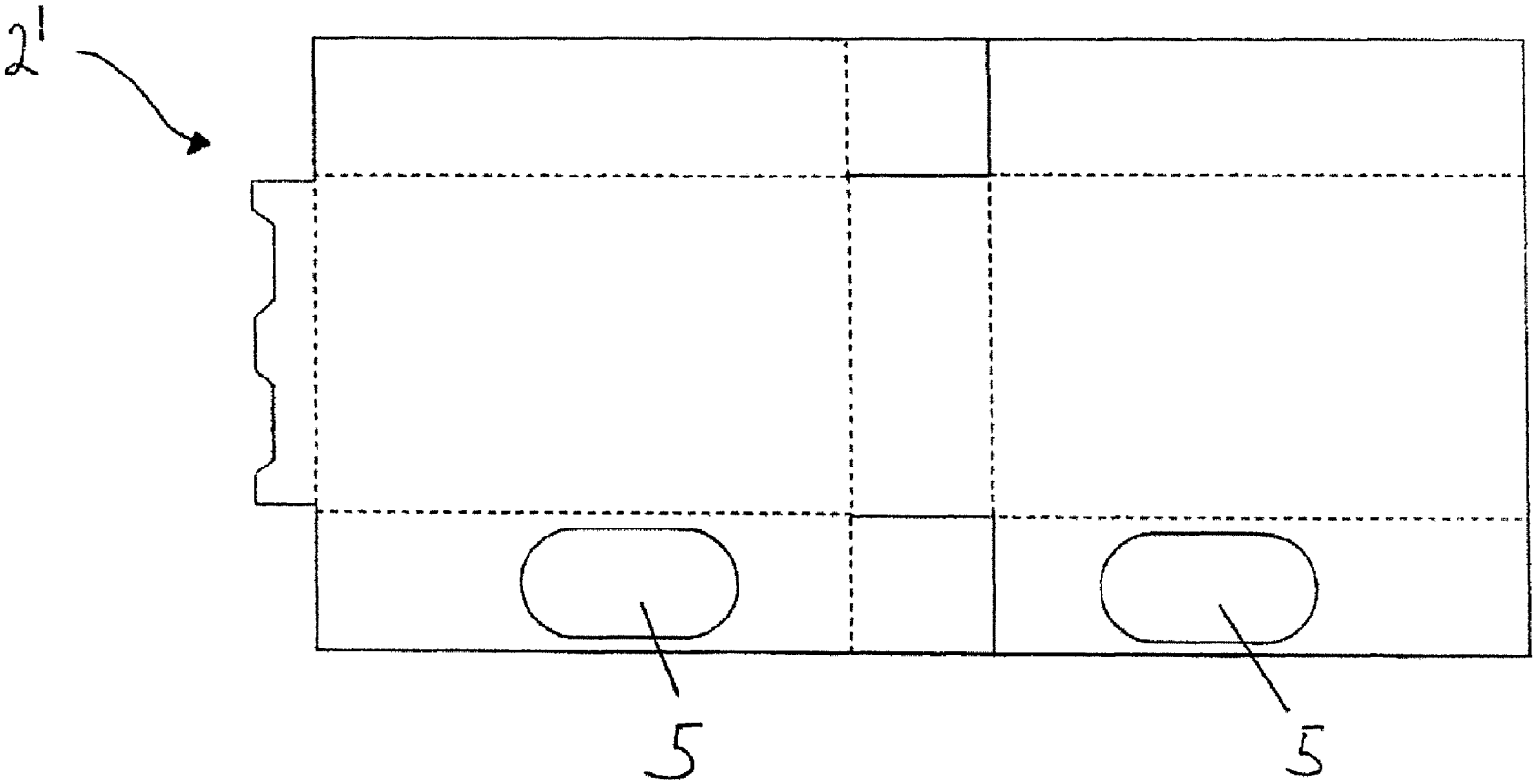
FIG. 5 shows a cutting for a second embodiment of an outer packet part.

FIG. 5 illustrates an alternative version 2' of the outer packet part illustrated in FIG. 4. It differs solely due to the position of the cut-out 5. It is disposed on a side face in this instance. Since two side flaps overlap when the packet is folded, it is necessary to provide the cut-out in both side flaps. In the folded state, the cut-outs are disposed on either side of the front face, although it would also be conceivable to provide cut-outs on only one side. Cut-outs on the left-hand packet side and the reverse face are also possible alternatives.

Figure 6:
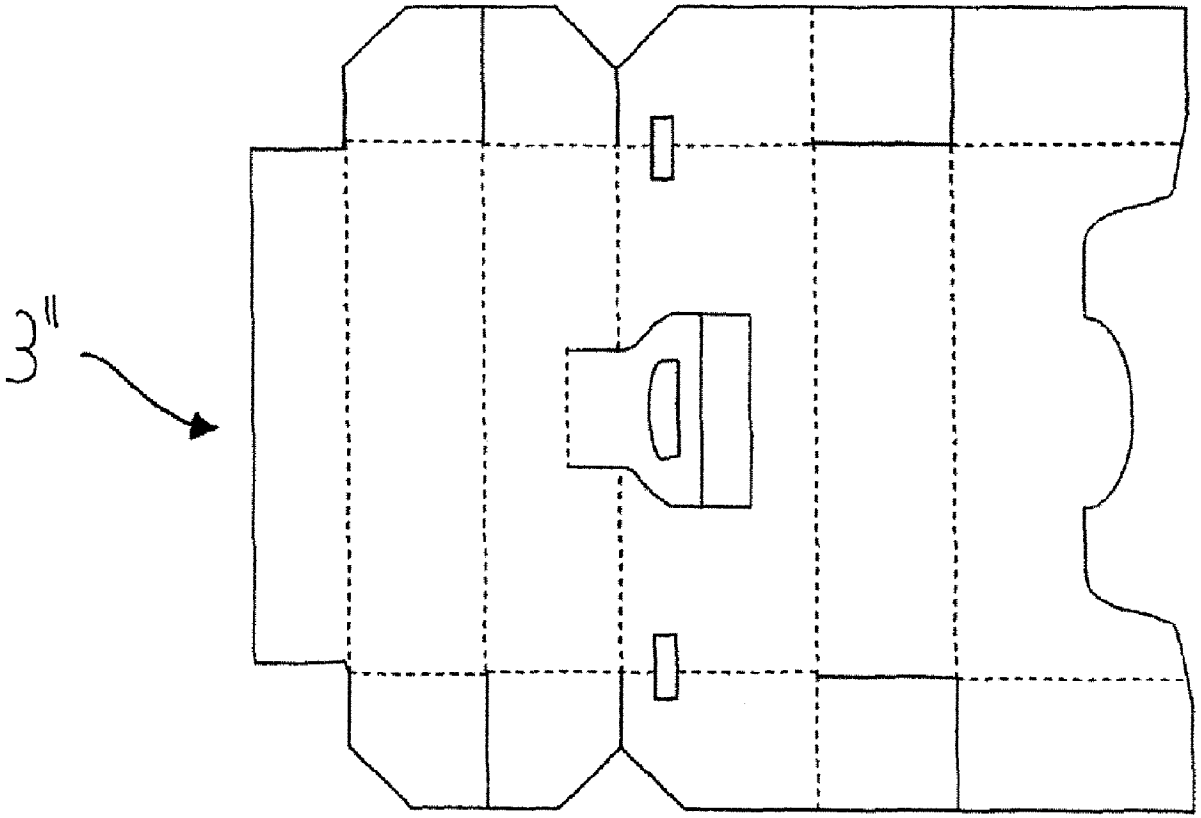
FIG. 6 shows a cutting for a third embodiment of an inner packet part.
Figure 7:
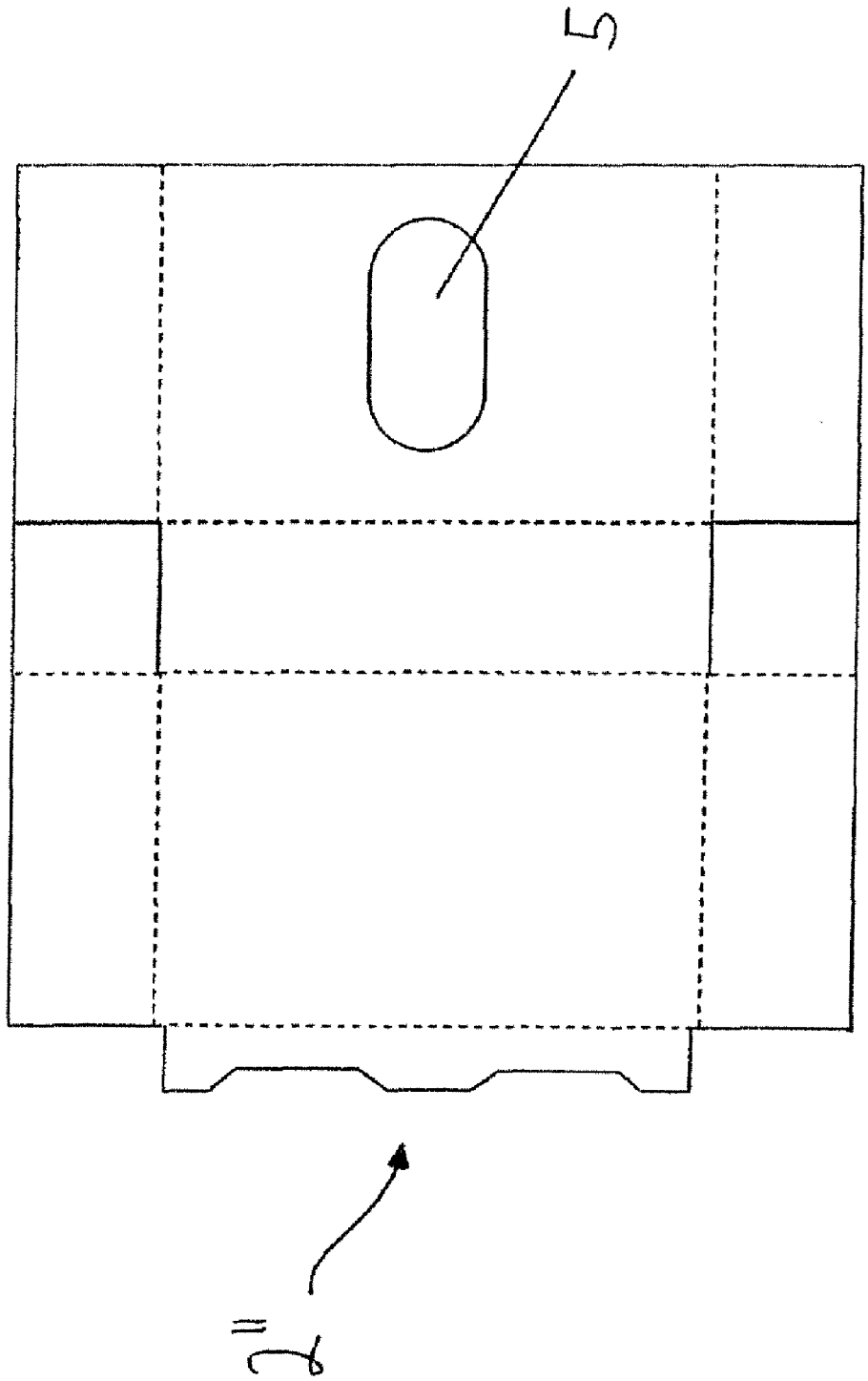
FIG. 7 shows a cutting for an outer packet part for the third embodiment.
Figure 8:
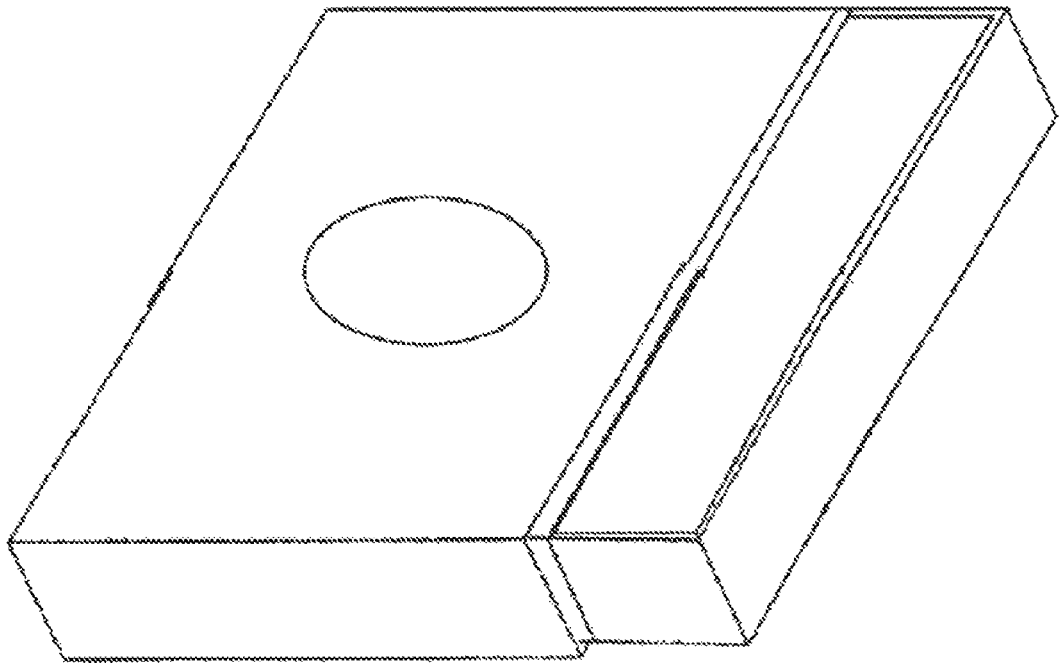
FIG. 8 shows a three-dimensional diagram of the opening mechanism of a packet for the third embodiment.

Another alternative embodiment of the invention is illustrated in FIGS. 6 and 7. By contrast with the packets illustrated in FIGS. 1 to 5, the inner packet part 3" in this instance is not pushed along the longitudinal axis of the cigarettes but perpendicular to the longitudinal axis of the cigarettes, thereby enabling the packet to be opened across the longitudinal side. To achieve this, it is merely necessary to vary the dimensions of the packet and insert the enclosed cigarette block parallel with the lid. The individual elements of the inner packet part 3" in FIG. 6 and the outer packet part 2" in FIG. 7 are identical to those illustrated in FIGS. 3 and 4.

LIST OF REFERENCE NUMBERS

1 Packet/slide and shell packet
2, 2', 2" Outer packet part/slide
3, 3', 3" Inner packet part/slide
4 Enclosed cigarette block
5 Cut-out/slide aperture
6 Lid
7 Tongue/Lid tab
10 Front face
11 Bottom face
12 Rear face
13 Reverse side of the lid
14 Top face
15 Lid stiffening
16*a* and *b* Side flaps of the front face
17*a* and *b* Side flaps of the bottom face/dust tabs
18*a* and *b* Side flaps of the rear face
19*a* and *b* Side flaps of the lid
20*a* and *b* Side flaps of the lid
21 Cut-out
22 Cut-out
23 Cut-out
24 Cut-out
30 Front face
31 Bottom face
32 Rear face
33 Tab
34 Opening lug
35*a* and *b* Stop lugs
36*a* and *b* Side flaps of the front face
37*a* and *b* Side flaps of the bottom face/dust flaps
38*a* and *b* Side flaps of the rear face

The invention claimed is:

1. A smoking article packet, comprising:

an inner packet part for accommodating smoking articles and an outer packet part for accommodating the inner packet part, wherein the outer packet part has a bottom face and one substantially open face through which the inner packet part is pushed out of the outer packet part; and at least one slide aperture in the outer packet part wherein the at least one slide aperture is formed in a face of the outer packet part adjacent to the open face, wherein a lid is disposed and articulated on the inner packet part and covers the open face of the outer packet part when the inner packet part is pushed in, wherein the lid is disposed on an articulation line of the inner packet part in a hinge arrangement so that it can be folded out, and a lid opening tab, formed by a cut in a rear face of the inner packet part, lies across the articulation line between a face of the lid and the rear face of the inner packet part, each face adjoining the articulation line, wherein the lid opening tab has a cut-out that engages an opening lug on the outer packet part in order to open the lid.

2. The smoking article packet of claim 1, wherein the face or a portion of the face with the at least one slide aperture is not parallel with the open face.

3. The smoking article packet of claim 1, wherein the at least one slide aperture is formed in a face which directly adjoins and is perpendicular to the open face.

4. The smoking article packet of claim 1, wherein the at least one slide aperture is disposed on at least one of two opposing side faces of the packet.

5. The smoking article packet of claim 1, wherein more than the at least one slide aperture is formed in one or more faces of the outer packet part which do not lie opposite the open face.

6. The smoking article packet of claim 1, wherein the packet is a packet of a three-dimensional rectangular shape with six faces, and the packet is formed with at least:

the open face as one of the shorter, narrow edge faces and the at least one slide aperture is formed in at least one of the longer, narrow edge faces or at least one of the main faces; or the open face as one of the longer narrow, edge faces and the at least one slide aperture is formed in at least one of the shorter narrow edge faces or at least one of the main faces; or the open face as one of the main faces and the at least one slide aperture is formed in at least one of the longer, narrow edge faces or at least one of the shorter, narrow edge faces.

7. The smoking article packet of claim 1, wherein the at least one slide aperture is a cut-out in the face of the outer packet part.

8. The smoking article packet of claim 1, wherein the at least one slide aperture has one of a circular, oval shape or an elongate slot shape.

9. The smoking article packet of claim 1, wherein the at least one slide aperture has a length in the pushing-out direction which corresponds to at least one fifth of the face length in the direction and may occupy up to 90% of the face length.

10. The smoking article packet of claim 1, wherein the at least one slide aperture has a width perpendicular to the pushing-out direction of at least 10 mm.

11. The smoking article packet of claim 1, wherein the inner packet part has a friction-enhancing or purchase-enhancing surface in the region of the at least one slide aperture or a slide aid.

12. The smoking article packet of claim 1, wherein the at least one slide aperture has a width perpendicular to the pushing-out direction of at least 5 mm.

13. The smoking article packet of claim 1, wherein the at least one slide aperture has a width perpendicular to the pushing-out direction of at least 2 mm.

14. The smoking article packet of claim 1, wherein the at least one slide aperture has a polygonal shape.

15. The smoking article packet of claim 1, wherein the outer packet part includes a front face and a rear face.

16. The smoking article packet of claim 15, wherein the inner packet part is pushed out of the outer packet part in a. direction perpendicular to a top edge of at least one of the front face and the rear face of the outer packet part.

17. The smoking article packet of claim 15, wherein the inner packet part is pushed out of the outer packet part in a direction parallel with a top edge of at least one of the front face and the rear face of the outer packet part.

18. The smoking article packet of claim 15, wherein the at least one slide aperture is disposed on at least one of the front face and the rear face of the outer packet part.

19. A smoking article packet, comprising:

an inner packet part for accommodating smoking articles and an outer packet part for accommodating the inner packet part, wherein, the outer packet part has a bottom face and one substantially open face through which the inner packet part can be pushed out of the outer packet part;

wherein a lid is disposed and articulated on the inner packet part, and a lid opening tab, formed by a cut in a rear face of the inner packet part, lies across an articulation line connecting a face of the lid with the rear face of the inner packet part, wherein both the face of the lid and the rear face of the inner packet part adjoin the articulation line; and wherein the lid opening tab has a cut-out that engages an opening lug on the outer packet part in order to open the lid.

20. The smoking article packet of claim 19, wherein a-tab having catch lugs is disposed. at an edge of the outer packet part, and is folded inwards by 180°.

21. The smoking article packet of claim 19, wherein the cutout of the lid opening tab lies closer to the articulation line than at least one other cut-out which is used to restrict the pushing-out movement.

* * * * *

UNITED STATES PATENT AND TRADEMARK OFFICE

CERTIFICATE OF CORRECTION

PATENT NO. : 8,245,841 B2
APPLICATION NO. : 12/096017
DATED : August 21, 2012
INVENTOR(S) : Erdinc Agirbas It is certified that error appears in the above-identified patent and that said Letters Patent is hereby corrected as shown below:

On the title page

Item (56) U.S. Patent Documents, delete "377,324 A 11/1973 Mueller"

On the title page (page 2):

U.S. Patent Documents, delete "393,329 A 1/1976 Shimada et al." and "426,792 A 5/1981 Toimil"

Signed and Sealed this
Twelfth Day of March, 2013

Teresa Stanek Rea
*Acting Director of the United States Patent and Trademark Office*